United States Patent [19]

Goller et al.

[11] Patent Number: 4,821,534

[45] Date of Patent: Apr. 18, 1989

[54] APPARATUS FOR CONTROLLING THE CARRIAGE DRIVE MOTOR OF A FLAT BED KNITTING MACHINE

[75] Inventors: Ernest Goller, Reutlingen; Jürgen Ploppa, Pfullingen; Adam Müller, Reutlingen, all of Fed. Rep. of Germany

[73] Assignee: H. Stoll GmbH & Co., Reutlingen, Fed. Rep. of Germany

[21] Appl. No.: 156,872

[22] Filed: Feb. 18, 1988

[30] Foreign Application Priority Data

Feb. 18, 1987 [DE] Fed. Rep. of Germany ..... 3705125

[51] Int. Cl.[4] ..... D04B 7/00

[52] U.S. Cl. ..... 66/60 R; 66/64 R

[58] Field of Search ..... 66/64 R, 60 R, 75.2, 66/157, 238

[56] References Cited

FOREIGN PATENT DOCUMENTS

| | | | |
|---|---|---|---|
| 59-173353 | 10/1984 | Japan | 66/64 R |
| 62-85057 | 4/1987 | Japan | 66/60 R |
| 62-85058 | 4/1987 | Japan | 66/157 |
| 62-206068 | 9/1987 | Japan | 66/60 R |
| 62-223349 | 10/1987 | Japan | 66/60 R |

*Primary Examiner*—Ronald Feldbaum

*Attorney, Agent, or Firm*—Jones, Tullar & Cooper

[57] ABSTRACT

An apparatus for controlling the carriage drive motor of a flat-bed knitting machine is provided with a device used for activating, accelerating and turning off the carriage drive motor. The apparatus has at least one manually operable handlebar, essentially extending along a longitudinal section of the machine. The handlebar is mechanically connected to the device which causes the activation, acceleration or turning off of the motor. In order to make possible by means of the already present manually operable handlebar not only the activation and turning off of the carriage movement, but at the same time a continuous adjustment of the speed of the drive motor or of the carriage along the needle bed from a very slow creep rate to working speed, it has been provided that the device causing the activation, acceleration or turning off of the motor have an electrical transducer which can be continuously adjusted by means of the handlebar and that the output of the transducer is a measure for the relative change to the present working speed.

17 Claims, 3 Drawing Sheets

APPARATUS FOR CONTROLLING THE CARRIAGE DRIVE MOTOR OF A FLAT BED KNITTING MACHINE

FIELD OF THE INVENTION

The present invention relates to an apparatus used for activating, accelerating and turning off of the carriage drive motor of a flat-bed knitting machine. The apparatus has at least one manually operable handlebar or pivot bar, essentially extending along a longitudinal section of the machine. The handlebar or pivot bar connected is mechanically connected to a device which causes the activation, acceleration or turning off of the motor.

BACKGROUND OF THE INVENTION

In such a flat-bed knitting machine, known from "Wirkereiund Strickerei-Technik" [Knitting Technology], 1974, pp. 65 to 70 of this kind the handlebar is connected With one part of a clutch, the other part of which is connected to be fixed against relative rotation with the drive shaft of the motor which is switched o during idle. A movement of the handlebar has the effect of engaging the two clutch parts of the clutch, which in this case is a friction clutch, and in this manner setting the carriage in motion. Although the carriage can in this way be connected and disconnected and also accelerated in a certain way, it is impossible to cause the carriage to move slowly and in an exactly defined way across the needled bed in this way, because the carriage can only be moved by steps along the needle bed by a reciprocating movement of the handlebar, i.e. by connecting and disconnecting it. However, a slow, continuous movement of the carriage along the needle bed is desired by the operator for controlled positioning of the machine, therefore a hand crank had to be used in this known flat-bed knitting machine in order to let the carriage move continuously along the needle bed at a slow or creep rate for positioning and checking of the stitch formation. Since the hand crank is fixed at one place, the operator cannot watch the needle bed at the same time.

A flat bed knitting machine is known from "Melliand Textileberichte" [Melliand Textile Reports], 8/1965, pp. 828 to 834, in which it is possible to start a clutch motor by turning of a handlebar and to put the carriage into motion along the needle bed. Although it is possible by means of this handlebar to put the carriage into slow motion without the use of a hand crank, this can only be done if prior to this the motor speed has been changed by swiveling the motor and thus changing a flexible V-belt pulley by means of a twist grip fixed on the machine frame. A change of speed so that a creep rate operation becomes possible, subsequently followed by a normal working speed, is only possible in a relatively cumbersome way.

SUMMARY OF THE INVENTION

It is an object of the present invention to provide a flat-bed knitting machine of the type mentioned above with which it becomes possible, with the aid of the already present manually operable handlebar, not only to switch the carriage movement on and off, but also to achieve a continuous speed adjustment of the drive motor or the carriage along the needle bed starting from a creep rate up to working speed.

This object is attained in a flat-bed knitting machine of the type mentioned above in that the device causing the activation, acceleration or turning off of the motor has an electric transducer which can be continuously varied by the handlebar and in that the output of the transducer provides a measurement for the relative change of a pre-set working speed.

By means of the steps realized in accordance with the present invention, a continuous and defined increase of the speed of the drive motor or of the carriage arrangement becomes possible and the acceleration can start with a creep rate. This continuous adjustment can be made from any position along the needle bed by means of the already present handle bar for activation and turning off. In this way an effective control during set-up and positioning of the machine and an exact and effortless check of the stitch formation at the start of producing a new knitted piece becomes possible. Handling and operation of the machine is considerably simplified. When referring to a pre-set work speed, the work speed during knitting or working along the needle bed as well as in the lift reversal phase, during which the carriage speed is slowed or speeded up, is meant.

In many flat-bed knitting machines a so-called resistance shut-off is used, i.e. the machine is stopped as soon as jolts appear which are caused by a needle break or other obstructions which hamper the carriage movement or make it more difficult. Such a resistance shut-off in the above mentioned flat-bed knitting machine is only possible after the handlebar has reached its end position, at which the carriage device has reached its working speed, since following this the engagement movement of the clutch, which otherwise could lead to a resistance shut-off, is terminated. In contrast thereto a smooth and continuous acceleration of the motor speed takes place in accordance with the present invention, thus making it possible to provide resistance shut-off from the start, i.e. even at creep rates.

A cost-effective switch design for the processing of the transducer output to obtain a relative change of the pre-set work speed is provided by connecting the transducer to a central date processing unit which is supplied with the working speed set by means of a knitting program, or a keyboard, or a safety device, and in that the output of the data processing unit controls the motor via a set value/actual value comparison stage.

The evaluation of the output of the transducer in regard to a change to be made in the work speed can take place, for example, linearly. However, for a more sensitive control in the area of creep rates it would be practical to provide a non-linear evaluation, for example in the form of a defined progessivity, by for example the data processing unit.

Since, as previously mentioned, the carriage is slowed during lift reversal and then accelerated again, problems may arise in regard to an overly rapid change in the output of the transducer during lift reversal, particularly during the slow down phase. To avoid this, it is possible by not considering the speed of the change in the output of the transducer to refrain from interfering with this slowing and acceleration process, even if the output of the transducer is increased during this lift reversal phase.

A switch in parallel with the transducer allows for the reaching of a certain minimum value for the transducer before the transducer output influences the control of the motor. By connecting the switch with an input of the data processing unit it is practical to influence the start of the processing of an already available output signal.

A further switch in parallel with the transducer which is connected with the output of the data processing unit or with a set value/actual value comparator connected to the motor also allows for the reaching of a certain minimum value for the transducer before the transducer output influences the control of the motor.

The handlebar can be in the form of, for example, a shaft rotable around its own axis. However, in the previously mentioned flat-bed knitting machine the handlebar is formed as a pivot bar such that the pivot bar is pivoted like a lever from an upper to a lower position or from a lower to an upper position around a pivot axis, for example thorough approximately a quarter of an arc. In order to keep this pivot movement, to which the operators have become accustomed, for the continuous speed control of the drive motor in accordance with the invention, an advantageous structural design is provided including a pivot lever arrangement connected, fixed against relative rotation, with a pivot axle of the pivot bar, the other end of which acts on a pivotable tooth segment which makes with a gear wheel coupled with the transducer in the form of a potentiometer.

The movement of the potentiometer which constitutes the transducer can at the same time be used for the connection of the one and/or the other switch, by the provision of a cam disk which can be brought into interaction with the switches, the gear wheel being connected, fixed against relative rotation, with the cam disk.

In accordance with the provision of a locking position for the pivot bar in one of its end positions which maximally activates the transducer it is practical to lock the end position which corresponds to the work speed of the flat-bed knitting machine. An advantageous structural design is provided by the provision of a cam disk acting on a spring loaded lower lever which has a locking surface on its periphery.

During acceleration of the carriage drive motor during, for example, an observation phase of the operation, it is particularly advantageous to provide the pivot bar with prestressing until it reaches its locked position for return movement in order to immediately stop the carriage in the event an error, without it having performed a swivel movement. This return can be realized either by the dead weight of the pivot bar and, if required, of the connecting mechanism and/or by a restoring spring.

Further details of the invention can be seen from the ensuing description in which the invention is described in detail by means of the exemplary embodiment shown in the drawings.

DETAILED DESCRIPTION OF THE PREFERRED EMBODIMENT

Figure 1:
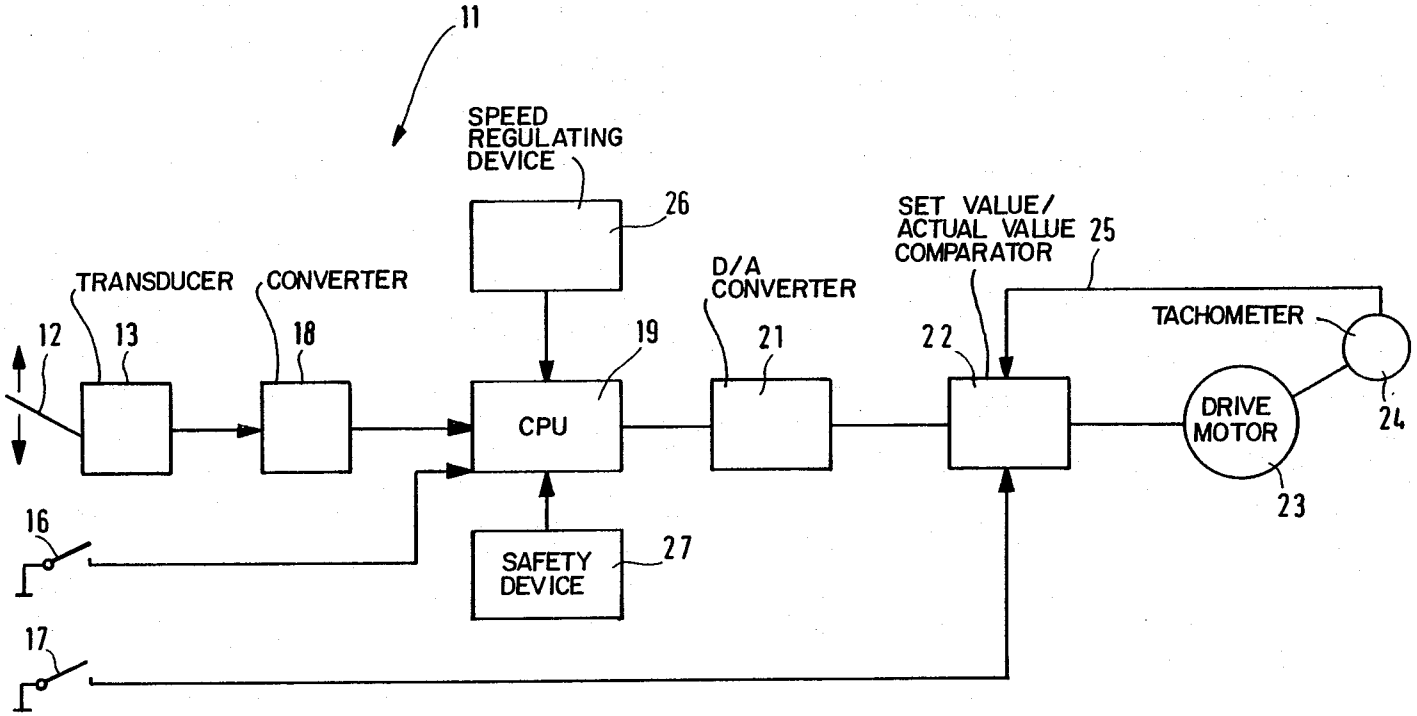
FIG. 1 is a block diagram of a device for activating, accelerating and turning of the carriage drive motor in a flat-bet knitting machine in accordance with a preferred embodiment of the present invention.

The device 11, shown in FIG. 1 in the form of a block diagram, is to be used in flat-bed knitting machines not only to connect or turn off a reversible drive motor 23 for moving the carriage arrangement of the flat-bed knitting machine along the needle bed of the machine, but also to particularly accelerate it under continuous control in order to make it possible to set different creep rates for the controlled set-up, continuous adjustment and/or observation of the stitch formation, as well as to make possible perhaps an already required resistance shut-off during the continuous acceleration of the drive motor or during its operation below working speed.

The control device 1 has an electric transducer 13 which in this case is in the form of a rotary potentiometer and which is connected, fixed against relative rotation, via a mechanism 15 (FIG. 2) with an engagement or pivot bar or bars 12 and to which are at the same time assigned two switches 16 and 17 which ar moved in definite association with the movement of the electrical transducer 13 by the pivot bar(s) 12.

The transducer 18 is connected via a converter 18 with an input of a data processing unit or CPU 19, the output of which is connected via a D/A converter 21 with a motor end stage 22 which is used for the control of the drive motor 23 of the carriage arrangement. A second input of the motor end stage 22 is connected with a return 25, Which is connected with a tachometer generator 24 driven by the motor 23, so that the motor end stage 22 at the same time performs a set value/actual value comparison. A third input of the motor end stage 22 is connected with a second switch 17 which constitutes a safety switch.

The CPU 19 is connected at a second input with a speed regulating device 26, which device 26 can be, for example, a key board or a mechanical or electronic memory provided with the program data. The first switch 16 is connected with a third input of the CPU 19 and serves as the functional control of the transducer. Furthermore, the output signal of a safety device 27, which is used as a resistance shut-off or disconnect in case of a thread break or the like, is fed to a fourth input of the CPU 19.

When the pivot bar 12 activated, the transducer 13 is moved so that an initial value or output signal is fed to the CPU 19. The CPU 19 changes the value of the carriage speed or motor rpm provided by the speed setting device 26 in accordance with the input to the transducer in such a way that the speed setting is reduced by a factor or to a percent value. It is possible for the CPU 19 to make a purely linear valuation or linkage of the factor provided by the transducer and of the value of the speed setting. For a more delicate control in the range of lower speeds it is possible for the CPU 19 to make a non-linear, for example, progressive valuation or linkage of the transducer value and the value of the speed setting, so that a speed change in the range of lower transducer value is less than in the range of higher transducer values.

However, valuation or linkage of the transducer value with the value of the speed setting by means of the CPU 19 is only possible if this is brought about by the first switch 16. This first switch 16 is activated after the transducer has attained or transmits a defined minimal value. Only then is linkage performed by means of the CPU 19, which only then feeds a control signal to the motor end stage 22, via the converter 21, so that the drive motor 23 starts or accelerates. If the pivot bar 12 is kept in a fixed position, for example, to maintain a creep rate, the drive motor 23 is adjusted to this speed with the aid of a set value/actual value comparison in the end stage 22, the set value being the value at the output of the CPU and the actual value being the value provided by the tachometer generator 24.

The second switch 17 is also activated only after the transducer 13 has attained a defined minimal value, the second switch 17 being connected shortly before the first switch 16 for releasing the motor end stage 22 for the control of the motor 23.

The speed setting device 26 sets a defined working speed which is adjustably set or programmed, depending on the fabric to be knit, the working speed being defined as the constant speed of the carriage arrangement during a working operation as well as the slowed down or accelerated movement of the carriage arrangement during lift reversal. This means that the carriage speed is slowed down from the working speed to zero and, after lift reversal, is again accelerated to working speed. If, prior to lift reversal, the pivot bar 12 has been activated and brought into and maintained in a defined intermediate position, slow down and acceleration proceed from or to this reduced speed or creep rate. However, if the pivot bar 12 is activated during the slowdown phase of the lift reversal and the transducer position thereby changed, it is provided that the CPU 19 suppresses or disregards this change of the transducer 13. In other words, the speed change of the moving pivot bar 12 or of the transducer 13 has no effect during the programmed speed change of the carriage movement during the lift reversal slow-down phase. However, during the acceleration phase of the lift reversal a change in the transducer 13 can be taken into consideration.

Figure 2:
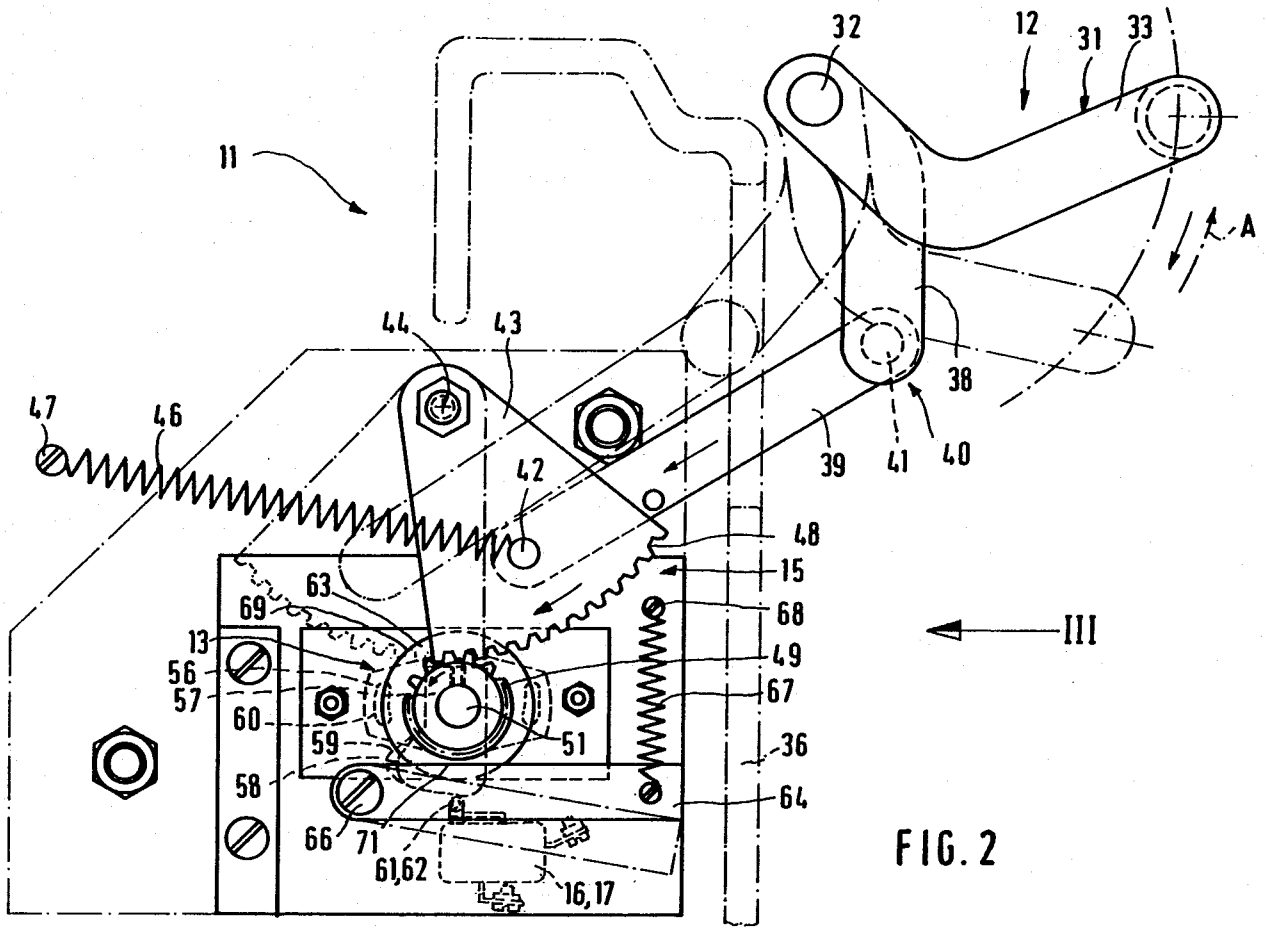
FIG. 2 is a side view of the structure of a transducer operable by a pivot bar as used in the device according to FIG. 1.
Figure 3:
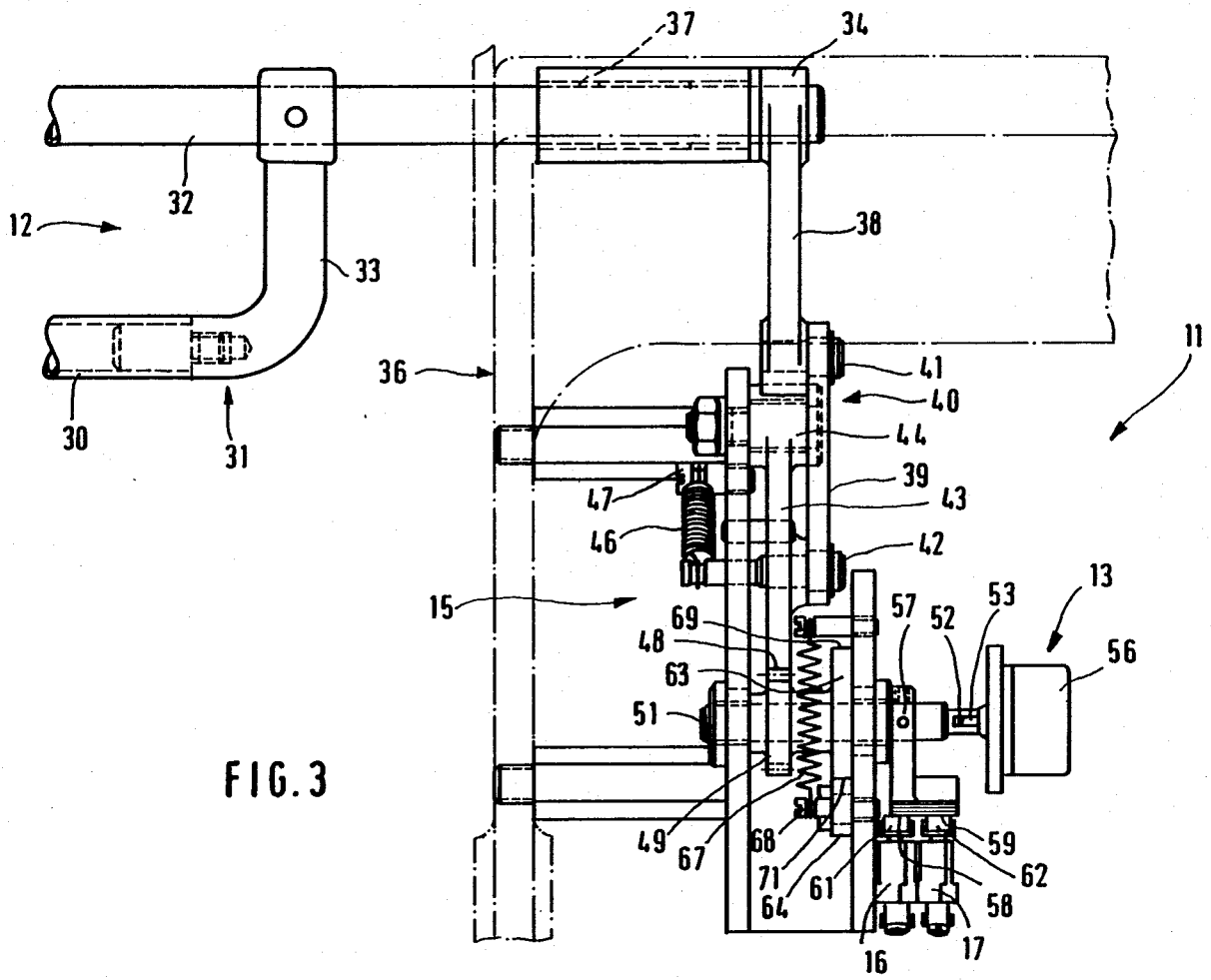
FIG. 3 is a view in the direction of the arrow III of FIG. 2.

FIG. 2 and 3 show a preferred structural design of the apparatus including the transducer 18 with the switches 16 and 17, the pivot bar 12 and the connection mechanism 15 to the transducer 13.

The pivot bar 12, Which essentially extends across the entire length of the needle bed in one or two parts has the form of one or two generally U-shaped handles 81, the free end(s) of which are connected, fixed against relative rotation, with a pivot axle in the form of a straight bar 32. The bar 82 rests, according to FIG. 3, With one of its ends in a bearing 37 located in a lateral section 34 of a frame 36 of the machine; the same applies, although not shown, to its other end. As shown in FIG. 2, the arms 33 of the handles 31 are in the shape of a boomerang. The bar-like area 30 of the handle 31 or the handles 31 of the pivot bar 12 extends between the two lateral arms 33.

In accordance with FIG. 3 a lever 38, which also has a boomerang shape, of a lever arrangement 40 is pushed, fixed against relative rotation, onto the free end of the bar 32 which extends from the bearing 37 and is facing away from the handle 31, the other end of the lever 38 which, in contrast to the forwardly pointing lateral arm 33, points downwardly, is pivotably connected via a pivot bolt 41 with a straight bar 39. The other end of the straight bar 39 is fastened by means of a cog 42 to a toothed segment 43 which itself is pivotable around its center 44. The cog 42 is disposed on the longitudinal center line extending through the center 44. A tension spring 46, the other end of which is attached to a stationary point 47, can act on the cog 42.

The toothed outer are 48 of the toothed segment 42 meshes with a gear wheel 49 which is located, fixed against relative rotation, on a shaft 51 which is rotationally disposed on the machine frame 36. The end of the shaft 51 away from the gear wheel 49 is provided with an axial slit 52, into which the operating end 53 of a wiper of a rotary potentiometer 56 is form fitted. A first pair of cam disks 57 is disposed, fixed against relative rotation, on the shaft 51 next to the operating end 53, the cam surfaces 58,59 are in active engagement with an operational member 61, 62 of the switches 16 or 17, one cam surface 59 slightly leading the other cam surface 58. The housing of the rotary potentiometer 56 is fixed and can be adjusted with respect to the shaft 51 through oblong slots 60.

Between the cam disk 57 and the gear wheel 49 a second cam disk 68, connected with the latter, is located, fixed against relative rotation, on the shaft 51. This cam disk 68 cooperates with a pivot lever 64, which is pivotable fixed with its one end to a fixed bolt 66 and is connected above, i.e. in the area of the toothed segment 48, with its free end to a tension spring 67, the other end of which is maintained stationary on a fixed pin 48. The second cam disk 63 has a circular peripheral surface 69, provided in one area with a flattening 71 on which the pivot lever 67 rests under the influence of the tension spring 67 when the pivot bar 12 is in the completely pulled-up ON-position, locking taking place in this position at the same time. In contrast thereto, the pivot lever 64 is pivoted downwardly out of the horizontal plane against the force of the tension spring 67 in all other pivot bar positions.

The operation of the pivot bar 12 and the transducer 13 is as follows: In FIG. 2 the OFF or zero position of the pivot bar 12 is shown in dash-dotted lines and the ON-position, which activates the carriage movement at working speed is shown in solid lines. Between these two end positions it is possible, by upward pivoting or pulling of the pivot bar 12, to continuously change the rpm of the drive motor 23 or the speed of the carriage arrangement along the needle bed arrangement. In the OFF or zero position the toothed segment 43 in the left position and the shaft 51 are pivoted in such a way that the cam disk 57 with the cam surfaces 58 and 59 no longer is in contact with the operational members 61, 62 of the switches 16, 17, and the pivot lever 64 is pivoted out of its horizontal position because of the peripheral surface 69 of the second cam disk 63. If the pivot bar 12 is now pulled upward in the direction of the arrow A, the wiper of the rotary potentiometer 56 is turned with the rotation of the shaft 51 and, after a defined small rotation, the cam surfaces 58, 59 of the cam disk 57 are brought into action one shortly after the other against the operational members 61, 62 of the switches 16, 17, pushing them downwards into their position. If the pivot bar 12 is maintained in its position. The carriage arrangement can be moved at a defined, constant slow speed or creep rate. By further lifting of the pivot bar 12 in the direction of the arrow A, the carriage speed is continuously increased, when the pivot bar 12 reaches the ON-position, the pivot lever 64 is again moved upwards by the force of the tension spring 67 and rests against the flattening 71 of the cam disk 63, which results in a locked position, out of which the pivot bar 12 can only be moved by active pushing in a direction opposite the arrow A. In contrast thereto, before the pivot bar 12 has attained the looked position, it always moves back in a direction opposite the arrow A, if released by the operator. The return of the pivot bar 12 and with it of the transducer 13 from one of these intermediate positions is caused by the dead weight of the pivot bar 12 and the lever arrangement 40. As shown by dashed lines it is also possible to aid this return by means of the tension spring 46.

As an alternative, the handle 31 can be replaced by a hollow shaft, located on the axle 32, which is turned by hand and is connected, fixed against relative rotation, with the lever 38 of the lever arrangement 40.

It is to be understood that the above description of the exemplary embodiment is by way of illustration only and the other variations and improvements are possible within the scope of the invention.

What is claimed is:

1. An apparatus for activating, accelerating and turning off the carriage drive motor of a flat-bed knitting machine, the drive motor having at least one manually operable handlebar which extends substantially along a longitudinal section of the machine and is mechanically connected to said apparatus, said apparatus comprising: an electrical transducer connected to and continuously adjustable by said handlebar, the output of said transducer being a measure of the relative change of the preset working speed of the drive motor.

2. The apparatus as define in claim 1, further comprising: a central data processing unit connected to the electrical transducer; a set value/actual value comparator connected to the central data processing unit and to the drive motor; and means connected to the central data processing unit for supplying said unit with the working speed of the carriage, wherein the output of the central data processing unit controls the drive motor via the set value/actual value comparator.

3. The apparatus as defined in claim 2, wherein said means supplies the work speed of the carriage by a knitting pattern.

4. The apparatus as defined in claim 2, wherein said means supplies the work speed of the carriage by a keyboard.

5. The apparatus as defined in claim 2, wherein said means supplies the working speed of the carriage by a safety device.

6. The apparatus as defined in claim 2, wherein the central data processing unit operates in a non-linear fashion on the output of the electrical transducer.

7. The apparatus as defined in claim 2, wherein a lift reversal of the carriage, speed changes in the electrical transducer output have no effect on the central data processing unit.

8. The apparatus as defined in claim 2, further comprising: a switch situated in parallel with the electrical transducer, said switch being activated by the electrical transducer after the electrical transducer reaches a minimum value.

9. The apparatus as defined in claim 8, wherein said switch is connected to a further input to the central data processing unit.

10. The apparatus as defined in claim 2, further comprising: a safety switch which is connected with the output of the central data processing unit, and which is activated by the electrical transducer after the electrical transducer reaches a minimum value.

11. The apparatus as defined in claim 2, further comprising: a safety switch which is connected with the set value/actual value comparator, and which is activated by the electrical transducer after the electrical transducer reaches a minimum value.

12. The apparatus as defined in claim 2, further comprising: a pivot axle; a pivot lever arrangement connected at one end fixed against relative rotation with the pivot axle; a pivotable toothed segment acted upon by the other end of the pivot lever arrangement; and a gear wheel, said gear wheel being coupled with the electrical transducer and in mesh with the toothed segment, wherein the electrical transducer is formed as a potentiometer and the handlebar is formed as a pivot bar pivotable around the pivot axle.

13. The apparatus as defined in claim 12, further comprising: a switch situated in parallel with the electrical transducer, said switch being activated by the electrical transducer after the electrical transducer reaches a mimimum value; a safety switch which is connected with the output of the central data processing unit and which is activated by the electrical transducer after the electrical transducer reaches a mimimum value; and a cam disk, wherein the gear wheel is connected, fixed against relative rotation, with the cam disk, and wherein the cam disk can be brought into interaction with said switch and said safety switch.

14. The apparatus as define in claim 12, further comprising: a switch situated in parallel with the electrical transducer, said switch being activated by the electrical transducer after the electrical transducer reaches a mimimum value; a safety switch is connected with the set value/actual vlaue comparator and which is activated by the electrical transducer after the electrical transducer reaches a mimimum value; and a cam disk, wherein the gear wheel is connected, fixed against relative rotation, with the cam disk, and wherein the cam disk can be brought into interaction with said switch and said safety switch.

15. The apparatus as defined in claim 12, wherein the pivot bar includes a locking position in one of its end positions which maximally activates the electrical transducer.

16. The apparatus as defined in claim 12, further comprising: a spring-loaded lever including a locking surface on its periphery; and a cam disk which acts on the spring-loaded lever.

17. The apparatus as defined in claim 16, wherein the pivot bar includes a locking position in one of its end positions which maximally activates the electrical transducer, and wherein the pivot bar is biased to its initial position in all positions except the locking position.

* * * * *